US006132262A

United States Patent [19]

Blanchet

[11] Patent Number: 6,132,262

[45] **Date of Patent: *Oct. 17, 2000**

[54] ELECTRICAL CONNECTOR WITH IMPROVED CONTACT RELIABILITY

[75] Inventor: Lucien Blanchet, Le Vesinet, France

[73] Assignee: Air-LB GmbH, Saarlouis, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/088,489

[22] Filed: Jun. 2, 1998

[30] Foreign Application Priority Data

Jun. 10, 1997 [FR] France ..... 97 07148

[51] Int. Cl.[7] ..... H01R 13/514

[52] U.S. Cl. ..... 439/752; 439/595

[58] Field of Search ..... 439/752, 603, 439/595

[56] References Cited

U.S. PATENT DOCUMENTS

| | | | |
|---|---|---|---|
| 4,921,448 | 5/1990 | Endo et al. | 439/595 |
| 4,979,912 | 12/1990 | Shindo et al. | 439/595 |
| 5,035,648 | 7/1991 | Kuiper-Moore | 439/752 |
| 5,520,553 | 5/1996 | Cecil, Jr. et al. | 439/595 |
| 5,647,776 | 7/1997 | Duclos et al. | 439/752 |
| 5,697,814 | 12/1997 | Delaunay | 439/595 |

FOREIGN PATENT DOCUMENTS

| | | |
|---|---|---|
| 2115556 | 7/1972 | France . |
| 2575612 | 7/1986 | France . |

*Primary Examiner*—Michael L. Gellner
*Assistant Examiner*—Antoine Ngandjui
*Attorney, Agent, or Firm*—Young & Thompson

[57] ABSTRACT

Electrical connector, the two parts (1, 2) of which each comprise, in a housing (5, 8), an insulator divided into a front part (6, 9) and a rear part (7, 10) which are provided with retaining means (23) for the contacts (3, 4) and with means (15) for securing the retaining means (23) in the plugged-in position of the contacts (3, 4). The two parts (6, 7; 9, 10) of the insulator of the two connector parts (1, 2) may be injection moulded from plastic, without any remachining.

10 Claims, 6 Drawing Sheets

ELECTRICAL CONNECTOR WITH IMPROVED CONTACT RELIABILITY

FIELD OF THE INVENTION

The present invention relates to an electrical connector formed from two parts intended for cooperating with one another by means of their respective front sides, each of the said parts comprising a housing and at least one contact comprising a retaining skirt and held in the housing by an insulator, into which the contact is plugged from the rear side and retained by the said skirt.

BACKGROUND OF THE INVENTION

For the general structure of such connectors and of their contacts which may, for example, be fastened directly to the ends of the conductors to be connected, it is possible to refer, for example, to the documents FR-A-2,115,556 and FR-A-2,575,912.

A problem which is presented by such connectors is in regard to the certainty that the contacts are correctly plugged into the connector parts. In fact, despite all the possible so-called electrical continuity checks, it is clear that, on such connectors, there are still always bad contacts which are attributable essentially to incompletely plugged-in contacts which, under operating conditions, give rise, under the effect of vibrations, to micro-cutoffs taking the form of random faults which are extremely difficult to locate.

SUMMARY OF THE INVENTION

The object of the present invention is, therefore, to provide an electrical connector of simple structure which, by virtue of a particular configuration of the connector, affords increased reliability in respect of the correct plugging of the contacts into the connector parts and, consequently, markedly improved contact reliability.

The electrical connector according to the invention is formed from two parts intended for cooperating with one another by means of their respective front sides, each of the said parts comprising a housing and at least one contact comprising a retaining skirt and held in the housing by an insulator, into which the contact is plugged from the rear side and retained by the said skirt. The insulator is divided transversely to the contact plug-in direction into a front part and a rear part comprising positioning means making it possible to hold them in a first mutual position, in which they are spaced from one another, and in a second mutual position, in which they are close to one another. The rear part comprises, for each contact, retaining means allowing the skirt of the contact to pass by experiencing elastic deformation when the skirt goes across them. The front part comprises, for each contact, securing means which are designed so as a) not to act on the retaining means of the rear part in the said first position, and b) to cooperate with the retaining means of the rear part, in order b1) to prevent passage from the said first position to the said second position when a retaining skirt of a contact has only partially gone across the retaining means of the rear part, and b2) to prevent a retaining skirt of a contact from going across the retaining means of the rear part in the said second position.

Thus, in order to make it possible to plug the contacts into the parts of the connector according to the invention, the two parts of the insulator must necessarily be located in the first position, since only in this position do the retaining means provided on the rear part allow the retaining skirt of each contact to pass. Since the crossing of the retaining means by the retaining skirt of the contact involves elastic deformation of the retaining means, this crossing is clearly detectable by the operator. Only subsequently, in a second stage, does the operator bring the two parts of the insulator into the second position, this passage from the first to the second position being possible only on condition that the retaining skirts have gone completely across the retaining means.

Preferably, the retaining means on the rear part of the insulator comprise, for each contact, a passage hole for the contact, together with its retaining skirt, and at least one flexible finger extending from the said hole in the direction of the front part, in such a way that the said finger experiences elastic bending when the retaining skirt passes. The securing means on the front part of the insulator, comprise, for each contact, a hole in the said part, for receiving that part of the contact which is located in front of the retaining skirt, and, at the rear of this hole, a receptacle shaped so as a) to be capable of receiving the said finger only when the finger is not deformed by a retaining skirt of a contact, and b) to immobilize the finger in the non-deformed state when it is engaged in the said receptacle.

According to a preferred embodiment, the retaining means on the rear part of the insulator comprise, for each contact, a plurality of fingers distributed in the manner of petals on a circle, and the receptacle in the front part of the insulator consists of a recess of revolution capable of receiving the said fingers.

Preferably, the said receptacle is connected to the hole receiving that part of the contact which is located in front of the retaining skirt by means of a shoulder serving as a stop for limiting the plug-in depth of the contact.

The fingers forming the retaining means may advantageously converge in the direction of their free end and comprise an inner boss between the location of their connection to the passage hole of the rear part of the insulator and their free end. This boss forms a hard point which is clearly detectable by the operator during the plugging-in operation.

Preferably, the means for positioning the two parts of the insulator relative to one another in the first and the second mutual positions may comprise snapping means produced in one piece with the said parts.

The said positioning means may, in particular, comprise, on one of the parts of the insulator, a protruding lug projecting towards the other part and carrying a tooth at its free end and, on the other part, two transverse notches spaced so as to make it possible, as a result of the bending of the said lug, for the tooth of the latter to snap into both of the said notches.

The said lug may preferably be formed on one of the parts of the insulator, so as to bend outwards and in such a position that this bending is prevented by the housing when the two parts of the insulator are mounted in the housing.

BRIEF DESCRIPTION OF THE DRAWINGS

Referring to the accompanying drawings, an illustrative non-limiting embodiment of a connector according to the invention will be described below in more detail; in the drawings.

DETAILED DESCRIPTION OF THE PREFERRED EMBODIMENTS

Figure 1:
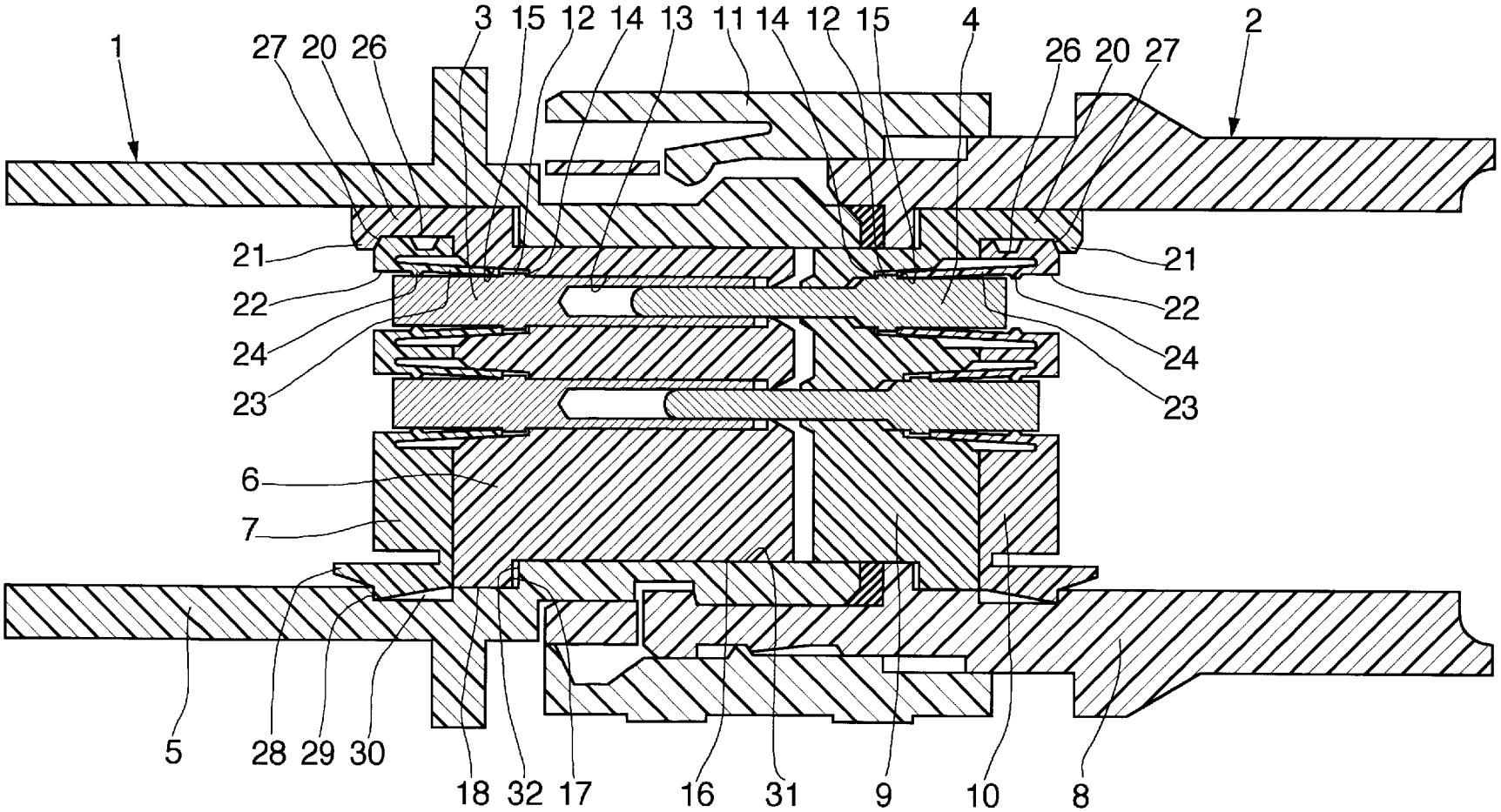
FIG. 1 is an axial section through a connector according to the invention, in the position in which the two connector parts are locked one on the other.

The connector, as illustrated in FIG. 1, comprises a first part 1 and a second part 2, here the first part 1 being a fixed part comprising female contacts 3 and the second part 2 being a movable part carrying male contacts 4.

The first part 1 comprises a housing 5, in which the contacts 3 are held by an insulator composed of a front part 6 and of a rear part 7.

Correspondingly, the second housing 2 comprises a housing 8, in which the contacts 4 are held by an insulator composed of a front part 9 and of a rear part 10. The housing 8 carries, moreover, a locking ring 11 which makes it possible to lock the two housings 5 and 8 one on the other when the two connector parts 1 and 2 are in the coupled position. This interlock is not the concern of the present invention and will not be described in any more detail.

Figure 2:
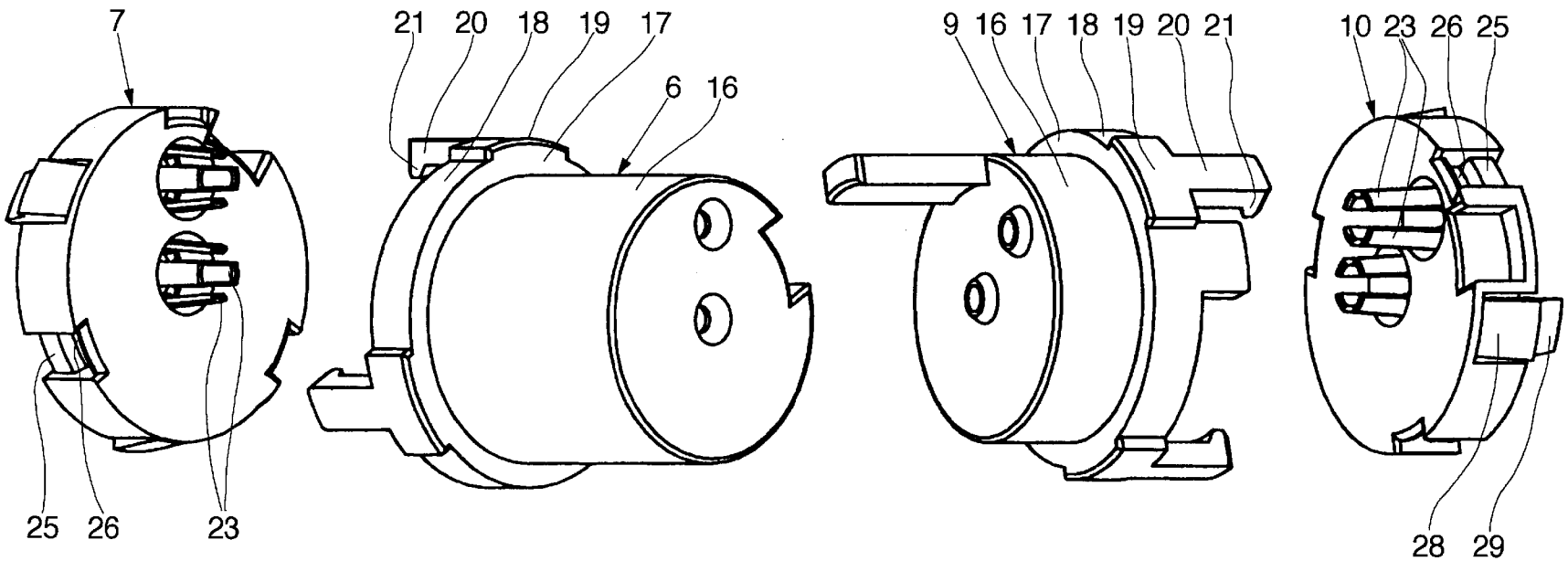
FIGS. 2 and 3 are perspective views of the two parts of the insulator of each of the two connector parts, without the housings and without the contacts.
Figure 3:
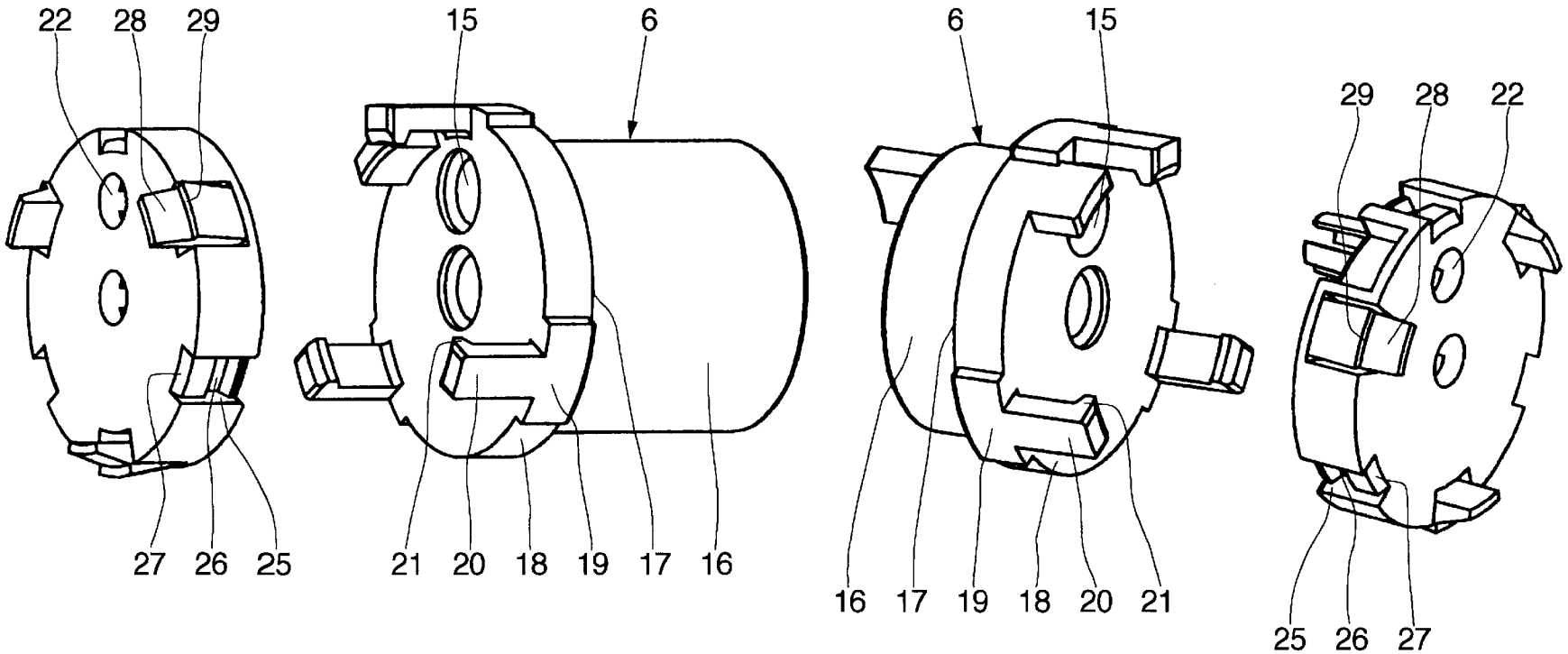

As emerges from FIGS. 2 and 3, the two parts 6, 7 and 9, 10 of the insulator of the two connector parts 1 and 2 are intended for a round connector with two contacts.

The two insulator parts 6, 7 of the connector part 1 differ from the two insulator parts 9, 10 of the connector part 2 essentially in the length of the front parts 6, 9 and in the dimensions of the holes provided in these parts 6, 9, one for receiving female contacts 3 and the other male contacts 4. Apart from these differences, the general structure of the parts 6 and 9, 10 on the one hand, and 7 and 10, on the other hand, is identical, as is the way in which these parts cooperate with one another, with the contacts 3, 4 and with the housings 5 and 8. Consequently, the following description will be given purely for the connector part 1, that is to say for the components 3, 5, 6 and 7, but this description applies likewise to the connector part 2, that is to say to the components 4, 8, 9 and 10 respectively.

The contact 3 comprises, for holding it in the connector part 1, a retaining skirt 12, by means of which the contact 3 is positioned axially relative to the two parts 6 and 7.

The front part 6 has, for each contact 3, an axial hole 13 which receives that part of the contact 3 which is located in front of the skirt 12, this hole 13 being connected at the rear, by means of a shoulder 14, to a frustoconical widening 15. Externally, the front part 6 comprises a cylindrical front portion 16, to which is connected rearwards, by means of a shoulder 17, a cylindrical portion 18 of increased diameter, carrying three bosses 19 distributed at 120° relative to one another. At the location of the bosses 19, three protruding lugs 20 project rearwards, each of these lugs 19 carrying, at its free end, an inner tooth 21 of trapezoidal shape.

The rear part 7 comprises, for each contact 3, a cylindrical passage hole 22 extended forwards by four protruding fingers 23. The diameter of the hole 22 is very slightly greater than the diameter of the skirt 12 of the contacts 3, and the fingers 23 converge in such a way that the distance between the opposite fingers 23 at the free ends of the latter corresponds substantially to the diameter of that part of the contact 3 which is located at the rear of the skirt 12. Each finger 23 comprises, moreover, on the inner side, a boss 24 between its connection to the rear part 7 and its free end.

Externally, the rear part 7 has a cylindrical lateral surface of the same diameter as the portion 18 of the front part 6, but with three indentations 25 which correspond to three lugs 20 of the front part 6 and which have a notch 26, the profile of which corresponds to the shape of the tooth 21, and a rear flank 27.

Moreover, the rear part 7 comprises in its outer lateral surface, at three locations offset relative to the indentations 25, three blocking lugs 28 extending so as to protrude rearwards and comprising an outer shoulder 29, by means of which the lugs 28 can come to bear in a groove 30 of the housing 5 in the position according to FIG. 1, in which position the cylindrical portion 16 of the front part 6 is engaged as far as it will go into the cylindrical front portion 31 of the housing 5, the shoulder 17 of the said front part bearing against a shoulder 32 of the housing 5.

Figure 4:
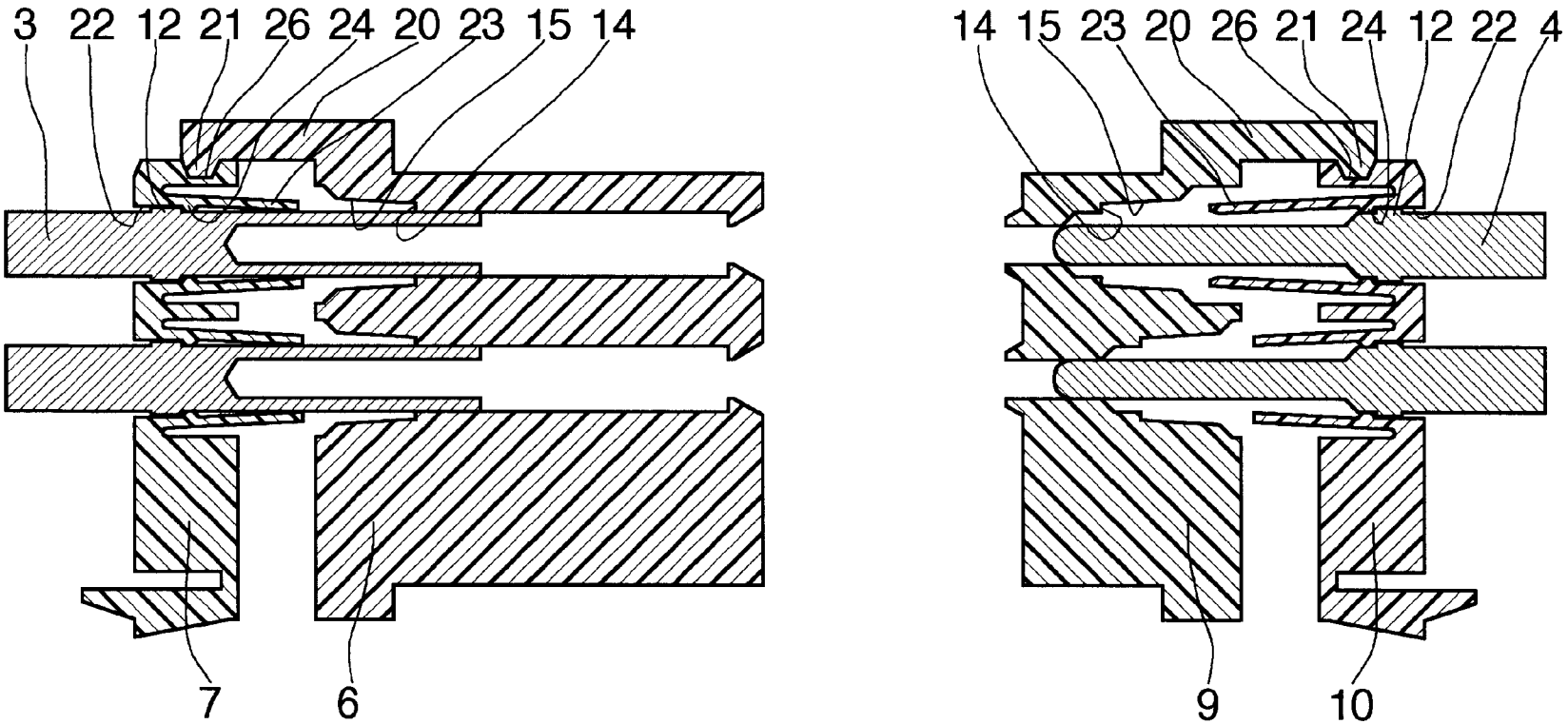
FIG. 4 is an axial section through the two parts of the insulator of the two connector parts, the rear parts of the insulator being in the retracted position and the retaining skirts of the contacts not yet having gone across the retaining fingers.
Figure 5:
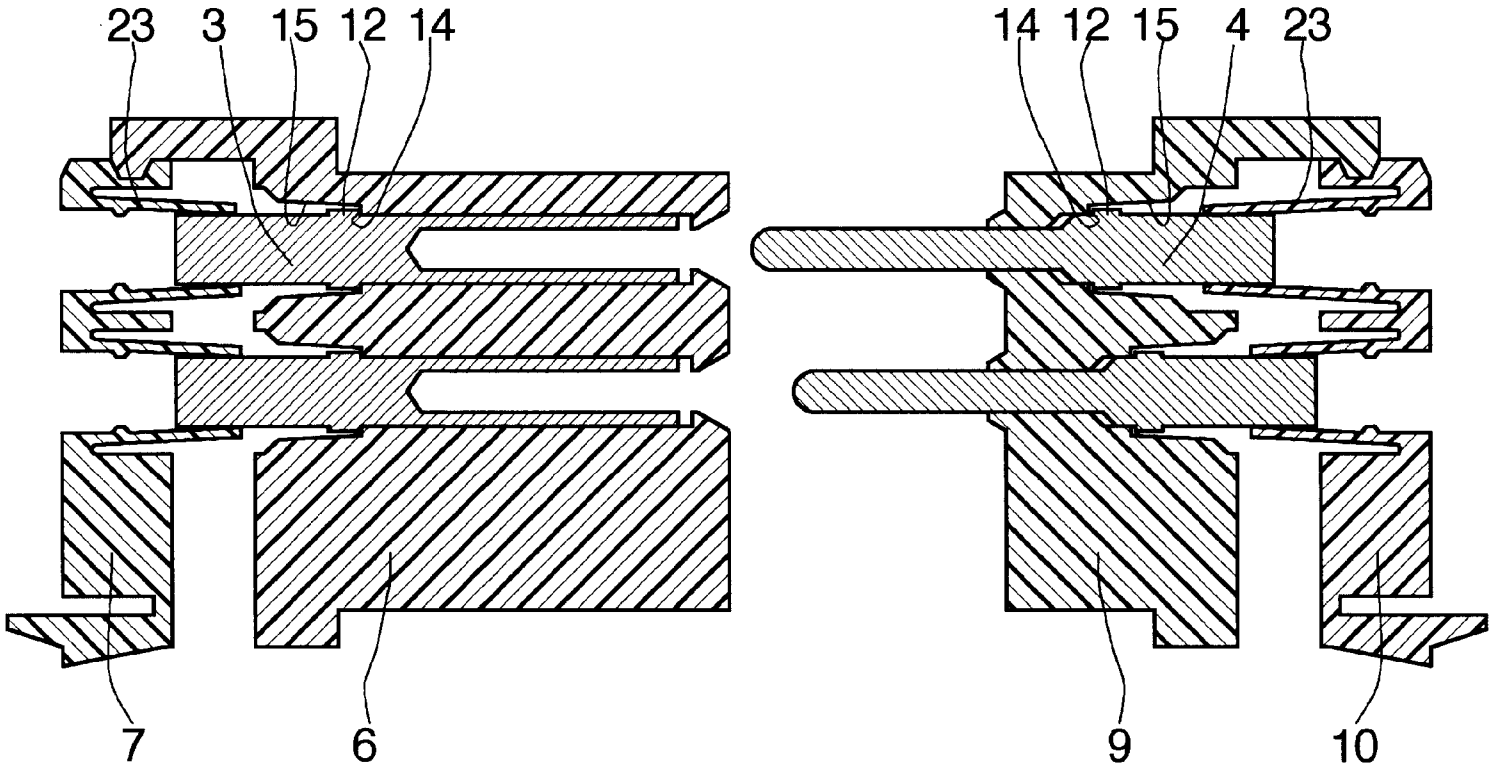
FIG. 5 is a section similar to that of FIG. 4, after the retaining skirts of the contacts have gone across the retaining fingers.
Figure 6:
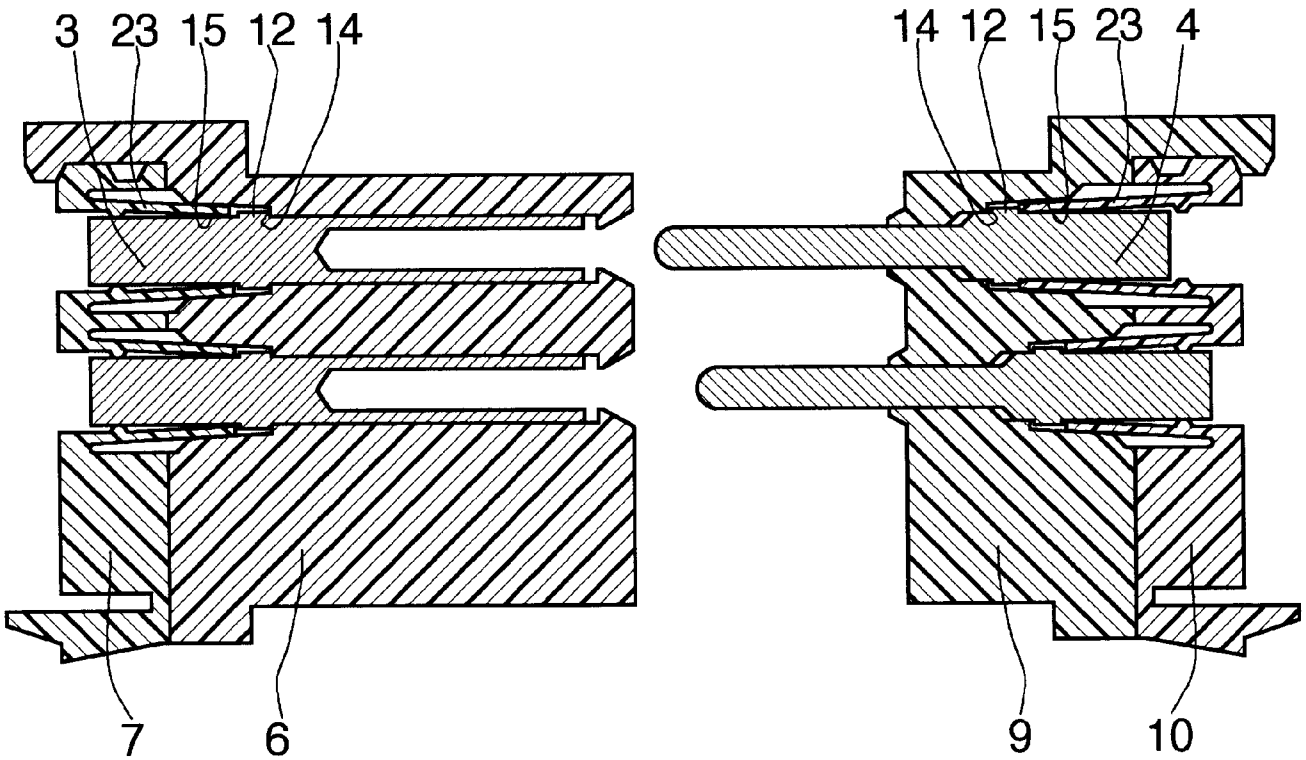
FIG. 6 is a section similar to that of FIGS. 4 and 5, the rear parts of the insulator being in the advanced position.

Referring to FIGS. 4 to 6, the various steps for plugging the contacts 3 into the connector part 1 (the plugging of the contacts 4 into the connector part 2 takes place in the same way) will be described below, only the two parts of the insulator of the two connector parts 1 and 2 being illustrated in these figures.

Before the contacts 3 are plugged in, the two parts 6 and 7 of the insulator are moved apart from one another, this position being defined by the snapping of the tooth 21 of the lugs 20 of the part 6 into the notch 26 of the indentations 25 of the part 7. In this position, the fingers 23 are released from the receptacle 15. The contacts 3 may be engaged from the rear through the holes 22 of the rear part 7, until the skirts 12 come to bear against the bosses 24 of the fingers 23 (FIG. 4), the said bosses forming a clearly detectable hard point.

After this hard point has been crossed by exerting an increased push on the contacts 3, the plugging-in of the latter may continue by moving apart the fingers 23 elastically by means of the skirts 12, until the skirts 12 bear against the shoulders 14 at the bottom of the receptacles 15, the said shoulders forming the plug-in stop for the contacts 3 (FIG. 5).

Subsequently, by exerting a push on the part 7 in the direction of the part 6 for the purpose of bringing them closer together, it is possible to release the teeth 21 from the notches 26, by bending the lugs 20 outwards, and to bring the two parts 6, 7 into the mutual position according to FIG. 6, in which the two parts are close to one another and are held by snapping the teeth 21 behind the shoulders 27. During this movement of bringing the parts 6, 7 closer together, the fingers 23 are driven into the receptacles 15 behind the skirts 12 of the contacts 3, thus ensuring that the skirts 12 are trapped between the shoulders 14 and the free ends of the fingers 23. In this position, the said fingers are blocked by the receptacle 15 which surrounds them (see FIG. 1) and prevents them from moving apart to allow a skirt 12 to pass.

It is expedient to note that, if, for any reason, in the position of the parts 6, 7 according to FIG. 5, a contact 3 had not been plugged in sufficiently for its skirt 12 to have gone across the free ends of the fingers 23, its skirt 12 would be immobilized between the fingers 23 and would keep these apart; in that case, the two parts 6 and 7 could not be brought into the close-together position according to FIG. 6, since the parted fingers 23 could not be engaged into the receptacle 15. The operator would thus be warned of this situation without any doubt and would be able to do what was necessary to remedy it.

Only when the two parts 6, 7 of the insulator have been brought into the mutual close-together position according to FIG. 6 is the assembly comprising the two parts 6, 7 and the contacts 3 inserted into the housing 5 and blocked in the latter by the lugs 28, as shown in FIG. 1.

After the same operations as those described in respect of the connector part 1 have been carried out on the connector part 2, the two connector parts 1 and 2 can be coupled and locked in the coupled state by means of the ring 11, as illustrated in FIG. 1.

It goes without saying that the embodiment illustrated and described has been given only as an indicative non-limiting example and that many modifications and variants are possible within the scope of the invention. Thus, the connector part 1 could comprise, for example, male contacts instead of female contacts or male contacts and female contacts, the other connector part 2 comprising complementary contacts. The connector could likewise be a non-circular connector and the number of contacts could be different from two.

FIGS. 2 and 3, in particular, show polarizing means provided on the parts 6, 7 and 9, 10 of the insulator of the two connector parts, but these means are not described in as much as they do not come within the scope of the present invention.

Other embodiments would likewise be conceivable with regard to the means for the mutual positioning of the two parts of the insulator of each connector part, and the fingers 23 and the receptacle 15 which receives the said fingers for the purpose of blocking them could be replaced by other means for retaining the skirts 12 of the contacts and by other means for securing or blocking these retaining means.

A considerable advantage of the embodiment shown and described is that all the components of the connector and, in particular, the two parts 6, 7 and 9, 10 of each connector part 1, 2 may be produced from plastic by simple injection moulding, without any remachining. Each connector half is thus composed of a minimum number of easily produced components, thus reducing the cost of the connector as a whole.

I claim:

1. Electrical connector formed from two parts (1, 2), each comprising a housing (5, 8), in which at least one contact (3, 4) comprising a retaining skirt (12) is held by an insulator (6, 7; 9, 10), the said contact being plugged from the rear side into the insulator and retained in the latter by its skirt, characterized in that the insulator of each connector part (1, 2) is divided transversely to the contact plug-in direction into a front part (6, 9) and a rear part (7, 10) comprising positioning means (20, 21, 26, 27) making it possible to hold them in a first mutual position, in which they are spaced from one another, and in a second mutual position, in which they are close to one another, in that the rear part (7, 10) comprises, for each contact (3, 4), retaining means (23) allowing the skirt (12) of the contact (3, 4) to pass by experiencing elastic deformation when the said skirt goes across them, and in that the front part (6, 9) comprises, for each contact (3, 4), securing means (15) which are designed so as a) not to act on the retaining means (23) of the rear part in the said first position, and b) to cooperate with the retaining means (23) of the rear part, in order b1) to prevent passage from the said first position to the said second position when a retaining skirt (12) of a contact (3, 4) has only partially gone across the retaining means (23), and b2) to prevent a retaining skirt (12) of a contact from going across the retaining means (23) in the said second position.

2. Connector according to claim 1, characterized in that means (28) for blocking the two parts (6, 7; 9, 10) of the insulator in the housing (5, 8), in the said second position, are formed on one of the said parts.

3. Connector according to claim 1, characterized in that the two parts (6, 7; 9, 10) of the insulator are injection moulded from plastic, without any remachining, together with the said positioning, retaining, securing and blocking means.

4. Connector according to claim 1, characterized in that the said retaining means comprise, for each contact, at least one retaining element (23) shaped so as to move apart as a result of elastic deformation when a skirt passes, and in that the said securing means comprise, for each contact, an element for immobilizing the said retaining element in the said second position.

5. Connector according to claim 4, characterized in that the retaining element comprises, for each contact, a plurality of protruding fingers (23) projecting in the manner of petals on the rear part in the direction of the front part, and in that the immobilizing element comprises a receptacle (15) formed in the front part, in such a way that the fingers (23) can engage into the said receptacle only if they are not parted and cannot part when they are engaged in the said receptacle.

6. Connector according to claim 5, characterized in that the receptacle (15) terminates, on the side remote from the rear part, in a shoulder (14) serving as a stop for limiting the plug-in depth of the contacts.

7. Connector according to claim 5, characterized in that each finger (23) comprises, on the inner side, a boss (24) between its connection to the rear part and its free end.

8. Connector according to claim 1, characterized in that the positioning means on the two parts (6, 7; 9, 10) of the insulator comprise snapping means produced in one piece with the two parts.

9. Connector according to claim 8, characterized in that the snapping means comprise, on one of the parts, a protruding lug (20) projecting towards the other part, so as to be capable of bending elastically, this lug carrying a tooth (21) at its free end, and, on the other part, two transverse notches (26, 27) spaced so as to make it possible for the said tooth to snap into both of the said notches.

10. Connector according to claim 9, characterized in that the said lug (20) is formed on one of the two parts, so as to bend outwards, in such a position that this bending is prevented by the housing (5, 8) when the two parts are mounted in the housing.

* * * * *